US010465699B2

(12) United States Patent
Montgomery et al.

(10) Patent No.: US 10,465,699 B2
(45) Date of Patent: Nov. 5, 2019

(54) COMPRESSOR BLADE LOCKING MECHANISM IN DISK WITH TANGENTIAL GROOVE

(71) Applicant: Doosan Heavy Industries & Construction Co., Ltd., Gyeongsangnam-do (KR)

(72) Inventors: Matthew Montgomery, Gyeongnam (KR); Iurii Goroshchak, Gyeongnam (KR); Joohwan Kwak, Gyeongnam (KR); Andrii Ievdoshyn, Gyeongnam (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 241 days.

(21) Appl. No.: 15/416,803

(22) Filed: Jan. 26, 2017

(65) Prior Publication Data

US 2018/0209439 A1 Jul. 26, 2018

(51) Int. Cl.

| | |
|---|---|
| ***F04D 29/32*** | (2006.01) |
| ***F04D 29/34*** | (2006.01) |
| ***F01D 5/32*** | (2006.01) |
| ***F01D 5/30*** | (2006.01) |

(52) U.S. Cl.

CPC ..... *F04D 29/322* (2013.01); *F01D 5/303* (2013.01); *F01D 5/32* (2013.01); *F04D 29/34* (2013.01); *F05B 2260/301* (2013.01)

(58) Field of Classification Search

CPC ... F01D 5/303; F01D 5/32; F01D 5/30; F01D 5/3023; F01D 5/3038; F01D 5/323; F01D 5/326; F01D 5/3007; F04D 29/322; F04D 29/34; F05D 2260/31; F05D 2260/30; Y10T 29/49321

USPC ..... 416/215

See application file for complete search history.

(56) References Cited

U.S. PATENT DOCUMENTS 1,687,891 A * 10/1928 Ray ..... F01D 5/3038 407/107
3,088,708 A 5/1963 Feinberg
3,826,592 A * 7/1974 Raboin ..... B63H 1/16 416/222

(Continued)

FOREIGN PATENT DOCUMENTS

JP H11-182494 A 7/1999
JP 4926186 B2 5/2012

(Continued)

OTHER PUBLICATIONS

A Korean Office Action dated Mar. 29, 2019 in connection with Korean Patent Application No. 10-2018-0007927 which corresponds to the above-referenced U.S. application.

*Primary Examiner* — Dwayne J White
*Assistant Examiner* — Wesley Le Fisher
(74) *Attorney, Agent, or Firm* — Invenstone Patent, LLC

(57) ABSTRACT

A compressor blade locking device can include: a first support including a first locking groove; a second support including a second locking groove; an upper plate disposed in the first locking groove and the second locking groove; and a plurality of bolts passing through the upper plate and coupled with the first support and the second support. The compressor blade locking device can further include a center support interposed between the first support and the second support.

20 Claims, 9 Drawing Sheets

(56) References Cited

U.S. PATENT DOCUMENTS

| | | | | |
|---|---|---|---|---|
| 6,647,602 | B2 | 11/2003 | Bachofner et al. | |
| 7,338,258 | B2 * | 3/2008 | Bachofner | F01D 5/3038 416/215 |
| 7,367,778 | B2 * | 5/2008 | Bachofner | F01D 5/3038 416/215 |
| 7,435,055 | B2 | 10/2008 | Hansen et al. | |
| 8,157,531 | B2 * | 4/2012 | Krutzfeldt | F01D 5/3038 416/215 |
| 8,206,116 | B2 | 6/2012 | Pickens et al. | |
| 9,255,483 | B2 * | 2/2016 | Farineau | F01D 5/32 |
| 9,341,071 | B2 | 5/2016 | Healy et al. | |
| 2005/0129522 | A1 * | 6/2005 | Kite | F01D 5/32 416/220 R |
| 2006/0018757 | A1 * | 1/2006 | Wagner | F01D 5/3015 416/220 R |
| 2009/0016889 | A1 * | 1/2009 | Krutzfeldt | F01D 5/3038 416/204 R |
| 2014/0363300 | A1 * | 12/2014 | Arita | F01D 5/32 416/222 |
| 2015/0101348 | A1 | 4/2015 | Hansen et al. | |
| 2017/0328226 | A1 * | 11/2017 | Kang | F01D 5/02 |
| 2018/0171807 | A1 * | 6/2018 | Kwak | F01D 5/3038 |

FOREIGN PATENT DOCUMENTS

| | | | | |
|---|---|---|---|---|
| JP | 2015-078688 | A | 4/2015 | |
| JP | 2015-078689 | A | 4/2015 | |
| WO | WO-2016085260 | A1 * | 6/2016 | F01D 5/02 |

* cited by examiner

500

COMPRESSOR BLADE LOCKING MECHANISM IN DISK WITH TANGENTIAL GROOVE

BACKGROUND OF THE INVENTION

A gas turbine generally comprises a compressor, a combustor, and a turbine, wherein the compressor provides compressed air generated by a plurality of compressor blades to the combustor. The plurality of compressor blades are engaged in a tangential groove of a disk and a plurality of spacers are engaged in the tangential groove between the plurality of compressor blades. Once the compressor blades and the spacers are installed sequentially in the tangential groove, the last remaining space in the tangential groove cannot be filled and secured by the compressor blades or the spacers because the remaining space is not enough for the spacer to be installed in the tangential groove. Thus, in the conventional design, a multi-piece spacer is used in such a manner that multiple parts are inserted into the remaining space and combined with each other. However, the prior art multi-piece spacer comprises so many parts including bolts and nuts that it is possible for multi-piece parts to disassemble and be released into the compressor blades, thereby causing damage to the compressor blades.

BRIEF SUMMARY

It is an object of the present disclosure to provide a compressor blade locking device which enables a reduction of the number of parts to facilitate disassembly and a lessening of a risk of damage to the compressor blades due to stray compressor blade assembly pieces.

The present invention relates to a compressor for a gas turbine, more particularly, to a compressor blade locking device for a compressor blade engaged in a tangential groove of a disk. Exemplary embodiments of the subject invention relate to a compressor blade locking device that substantially obviates one or more of the above disadvantages/problems and provides one or more of the advantages as mentioned below. In many embodiments, a compressor blade locking device comprises an upper plate disposed in a first locking groove of a first support and in a second locking groove of a second support.

According to one aspect of the present invention, a compressor blade locking device can include: a first support including a first locking groove having a first planar surface extending in a tangential direction and facing in a radial direction; a second support including a second locking groove having a second planar surface extending in the tangential direction and facing in the radial direction; an upper plate disposed in the first locking groove and in the second locking groove; and a plurality of bolts passing through the upper plate and coupled with the first support and the second support.

According to another aspect of the present invention, a compressor blade locking device can include: a first support including a first top surface; a second support including a second top surface; a center support interposed between the first support and the second support; an upper plate including a bottom surface that is disposed on a center top surface of the center support and sides surfaces that are disposed between the first top surface and the second top surface; a first bolt passing through the upper plate and coupled with the first support; and a second bolt passing through the upper plate and coupled with the second support.

According to another aspect of the present invention, a compressor blade locking device can include: a first support including a first bottom groove; a second support facing the first support; a center support interposed between the first support and the second support; and a bendable tab interposed between the first support and the center support, wherein the bendable tab comprises: a bottom end disposed in the first bottom groove; a tab body interposed between the first support and the second support; and a top end disposed on a center top surface of the center support.

Accordingly, the compressor blade locking device of the present invention, in which an upper plate is disposed in a first locking groove of a first support and in a second locking groove of a second support, can reduce the number of parts and can thus facilitate disassembly. In addition, due to the fewer components for assembly, there is a lessening of a risk of damage to the compressor blades due to stray compressor blade assembly pieces.

DETAILED DESCRIPTION

Figure 1:
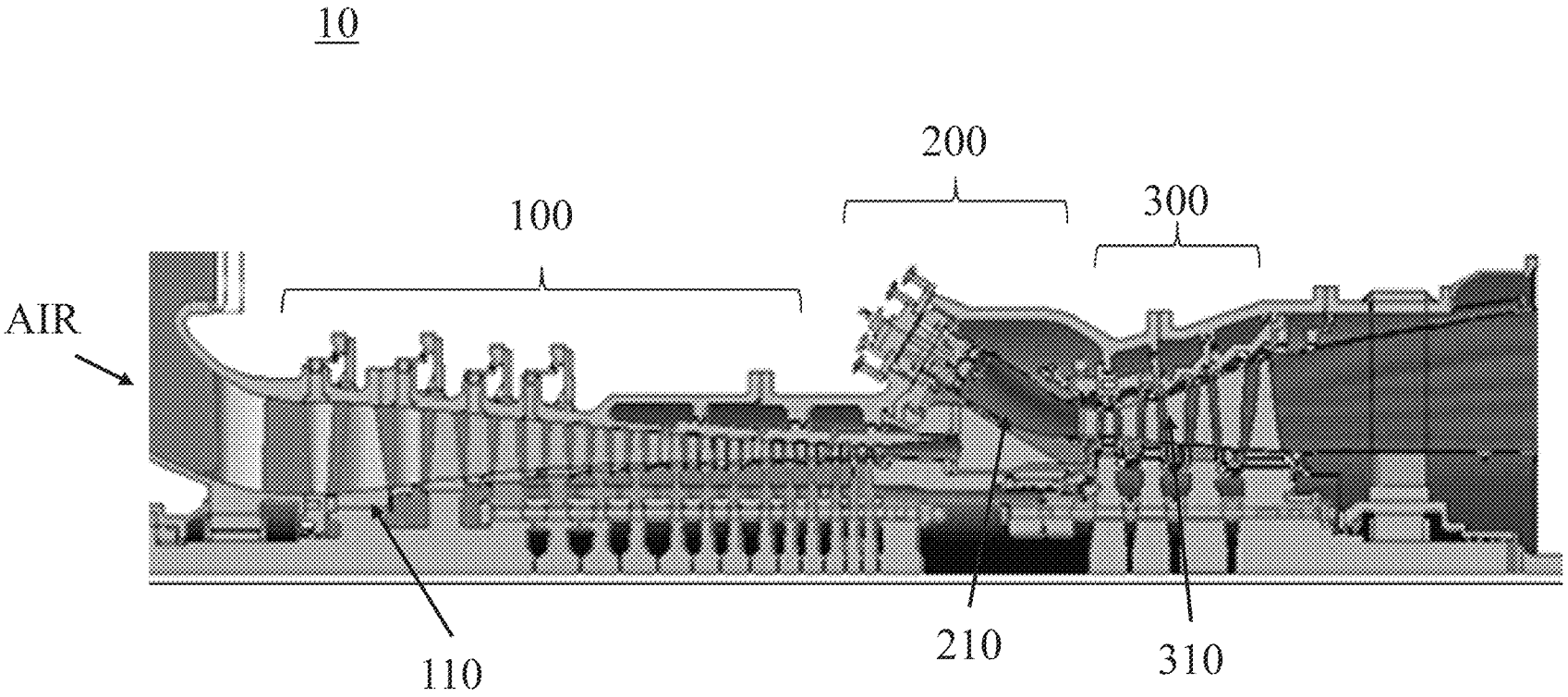
FIG. 1 is a cross-sectional view of a gas turbine according to an embodiment of the subject invention.

When the terms "on" or "over" are used herein, when referring to layers, regions, patterns, or structures, it is understood that the layer, region, pattern, or structure can be directly on another layer or structure, or intervening layers, regions, patterns, or structures may also be present. When the terms "under" or "below" are used herein, when referring to layers, regions, patterns, or structures, it is understood that the layer, region, pattern, or structure can be directly under the other layer or structure, or intervening layers, regions, patterns, or structures may also be present. The terms "includes" and "including" are equivalent to "comprises" and "comprising" respectively.

In addition, references to "first", "second", and the like (e.g., first and second portion), as used herein, and unless otherwise specifically stated, are intended to identify a particular feature of which there may be more than one. Such reference to "first" does not imply that there must be two or more. These references are not intended to confer any order in time, structural orientation, or sidedness (e.g., left or right) with respect to a particular feature, unless explicitly stated. In addition, the terms "first" and "second" can be selectively or exchangeably used for the members.

Furthermore, "exemplary" is merely meant to mean an example, rather than the best. It is also to be appreciated that features, layers and/or elements depicted herein are illustrated with particular dimensions and/or orientations relative to one another for purposes of simplicity and ease of understanding, and that the actual dimensions and/or orientations may differ substantially from that illustrated. That is, a dimension of each of the elements may be exaggerated for clarity of illustration, and the dimension of each of the elements may be different from an actual dimension of each of the elements. Not all elements illustrated in the drawings must be included and limited to the present disclosure, but the elements except essential features of the present disclosure may be added or deleted.

It is to be understood that the figures and descriptions of embodiments of the present invention have been simplified to illustrate elements that are relevant for a clear understanding of the invention, while eliminating (in certain cases), for purposes of clarity, other elements that may be well known. Those of ordinary skill in the art will recognize that other elements may be desirable and/or required in order to implement the present invention. However, because such elements are well known in the art, and because they do not facilitate a better understanding of the present invention, a discussion of such elements is not provided herein.

Reference will be made to the attached figures on which the same reference numerals are used throughout to indicate the same or similar components. With reference to the attached figures, which show certain embodiments of the subject invention, it can be seen in FIG. 1 that, in an embodiment, a gas turbine 10 includes a compressor 100 having a compressor blade 110, a combustor 200 having a combustion chamber 210, and a turbine 300 having a turbine blade 310. Air is provided according to the arrow direction to the compressor blade 110 and compressed in the compressor 100, and then the compressed air is provided to the combustor 200. The air may pass through several compressor blades 110 located in several stages in an axial direction and be gradually compressed. The compressed air provided by the compressor 100 is combusted with a fuel in the combustion chamber 210, thereby producing a hot gas. The hot gas generated in the combustion chamber 210 is supplied to the turbine blade 310 such that the turbine blade 310 turns.

Figure 2B:
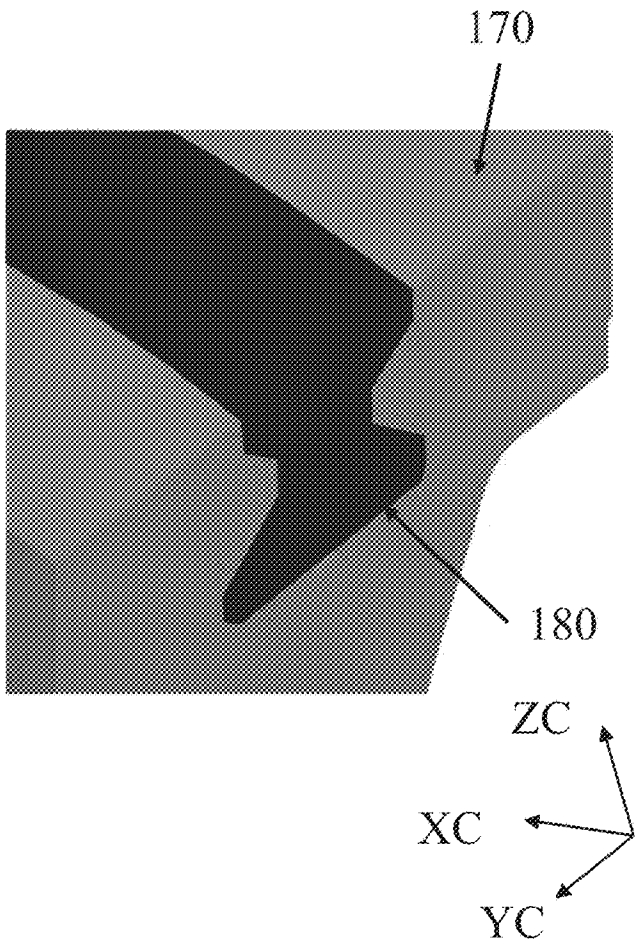
FIGS. 2(*a*) and 2(*b*) are perspective views of a compressor bladed disk according to a first embodiment of the subject invention.
Figure 2A:
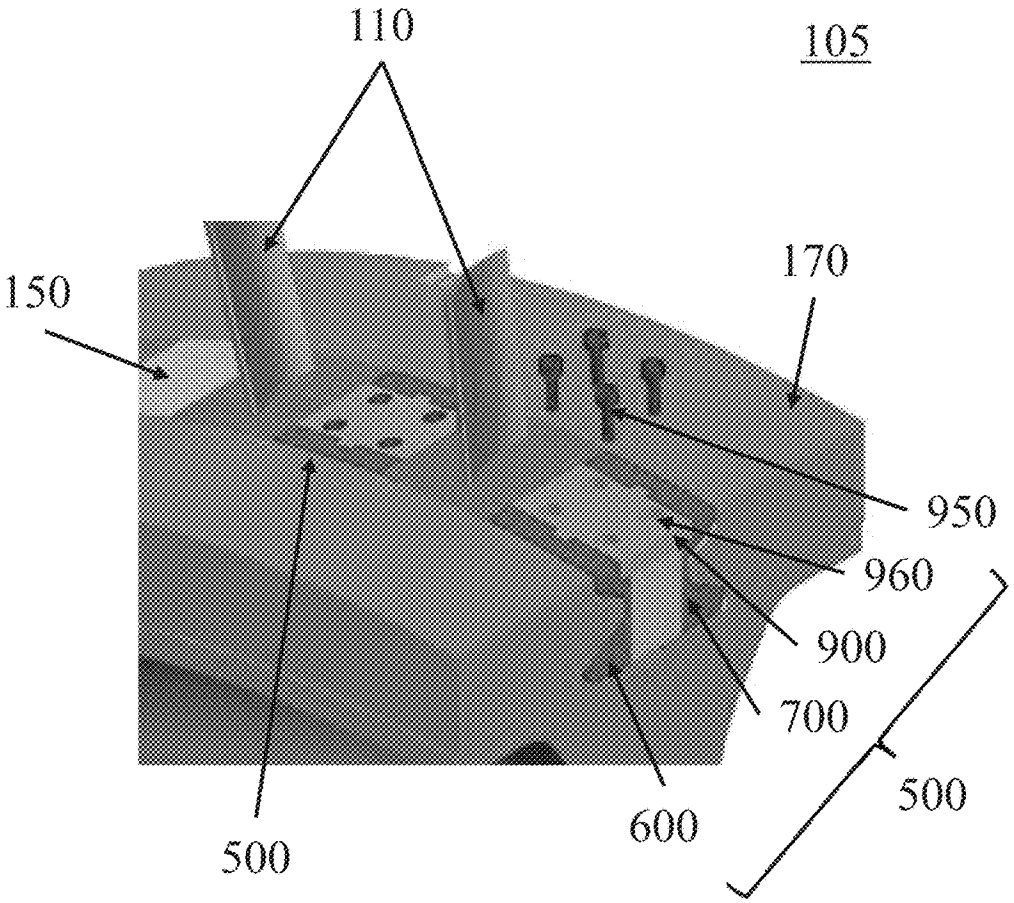

FIGS. 2(*a*) and 2(*b*) are perspective views of a compressor bladed disk according to a first embodiment of the subject invention. A compressor bladed disk 105 can be used in any stage in the compressor 100 and the compressor bladed disk 105 can be coupled with another compressor bladed disk 105.

The compressor bladed disk 105 includes a disk 170 having a rim shape, a plurality of compressor blades 110 engaged in a tangential groove 180 of the disk 170, a plurality of spacers 150 engaged in the tangential groove 180 of the disk 170, and a compressor blade locking device 500 engaged in the tangential groove 180 of the disk 170, thereby filing a space in the tangential groove 180 of the disk 170. The spacers 150 are placed between the compressor blades 110 and the compressor blade locking device 500 is placed between the compressor blades 110.

Each of the compressor blades 110 and the spacers 150 is inserted into the tangential groove 180 of the disk 170 in a radial direction ZC and then turned such that the compressor blades 110 and the spacers 150 are aligned along an axial direction YC in the tangential groove 180 of the disk 170. Thus, the compressor blades 110 are inhibited from being disengaged from the disk 170 in the radial direction ZC, and in the axial direction YC. The compressor blades 110 and the spacers 150 are placed alternately in the tangential groove 180 along a tangential direction XC. The remaining space in the tangential groove 180 of the disk 170 that the compressor blades 110 and the spacer 150 do not fill is filled by inserting the compressor blade locking device 500 including a first support 600, a second support 700, and an upper plate 900. Each of the first support 600, the second support 700, and the upper plate 900 is inserted separately into the tangential groove 180 and then coupled with each other through a plurality of bolts 950 such that the compressor blade locking device 500 is not disengaged from the disk 170.

The upper plate 900 is interposed between the first support 600 and the second support 700, thereby inhibiting the first 600 and second 700 supports from moving to each other. The plurality of bolts 950 pass through a plurality of nut holes 960 of the upper plate 900 and coupled with the first support 600 and the second support 700, thereby combining the upper plate 900, the first support 600, and the second support 700. In addition, each of the first support 600 and the second support 700 is coupled with the tangential groove 180 of the disk 170. As a result, the compressor blade locking device 500 is secured to the disk 170 and is not disengaged from the disk 170. The compressor bladed disk 105 can include a plurality of compressor blade locking devices 500 and the positions of the compressor blade locking device 500 can be determined based on the weight balance. For example, first and second compressor blade locking devices are placed such that one compressor blade is located between the compressor blade locking devices or first and second compressor blade locking devices are placed in the tangential groove such that the first and second compressor blade locking devices are point symmetric with respect to an axis of the disk 170.

Figure 3B:
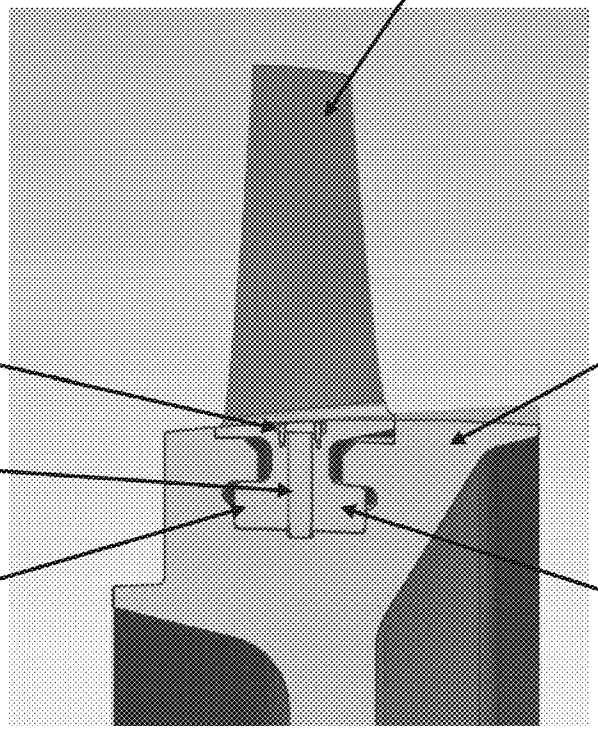
FIGS. 3(*a*) and 3(*b*) are a perspective view and a cross-sectional view of a compressor bladed disk according to a second embodiment of the subject invention.
Figure 3A:
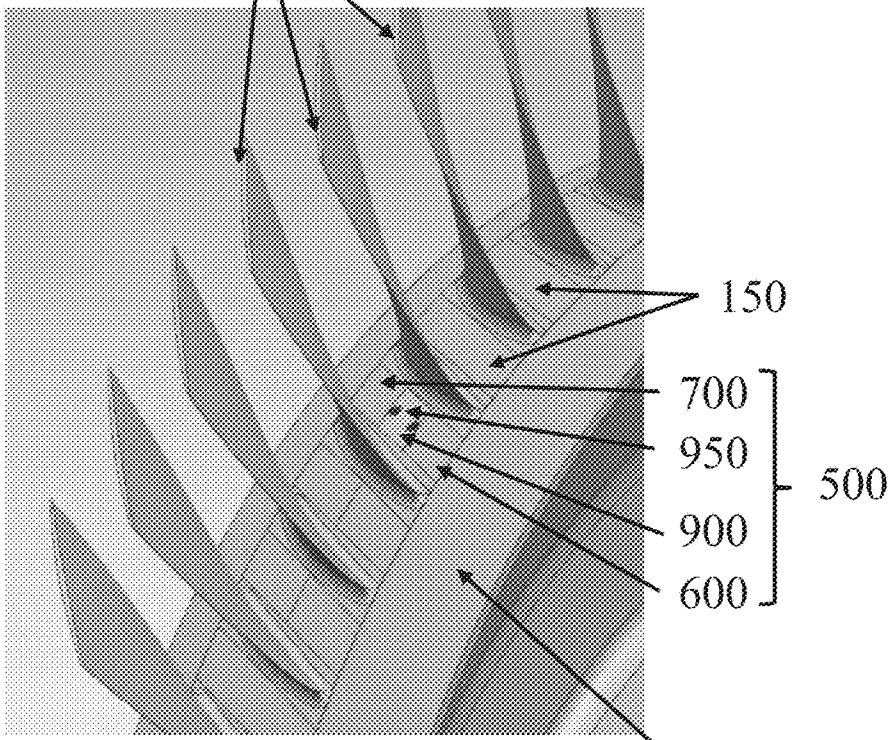

FIGS. 3(*a*) and 3(*b*) are a perspective view and a cross-sectional view of a compressor bladed disk according to a second embodiment of the subject invention. The compressor bladed disk 105 includes a disk 170 having a rim shape, a plurality of compressor blades 110 engaged with the disk 170, a plurality of spacers 150 engaged with the disk 170, and a compressor blade locking device 500 engaged with the disk 170. The spacers 150 are placed between the compressor blades 110 and the compressor blade locking device 500 is placed between the compressor blades 110.

The compressor blade locking device 500 includes a first support 600, a second support 700, a center support 800, and an upper plate 900. Each of the first support 600, the second support 700, the center support 800, and the upper plate 900 is inserted separately and then coupled with each other through a plurality of bolts 950 such that the compressor blade locking device 500 is not disengaged from the disk 170.

Figure 4:
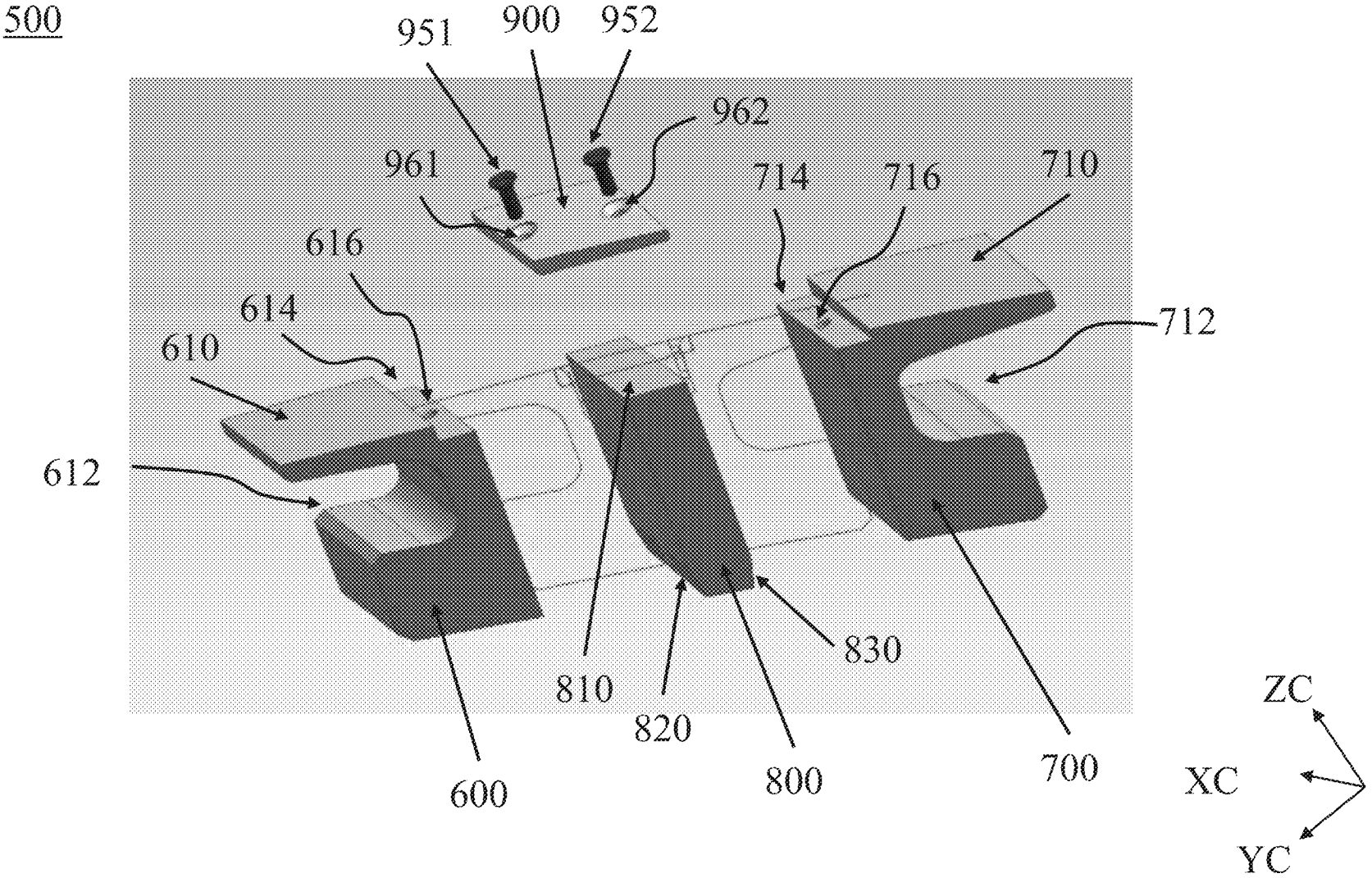
FIG. 4 is an expanded view of a compressor blade locking device according to a second embodiment of the subject invention.

FIG. 4 is an expanded view of a compressor blade locking device according to a second embodiment of the subject invention. Referring to FIG. 4, it can be seen that in this embodiment, a compressor blade locking device 500 comprises a first support 600, a second support 700, a center support 800, and an upper plate 900.

The first support 600 includes a first tangential groove 612 configured to correspond to a tangential groove of a disk, a first locking groove 614 formed on a first top surface 610, and a first locking hole 616 formed in the first locking groove 614. The first tangential groove 612 secures the first support 600 to the disk.

Similarly, the second support 700 includes a second tangential groove 712 configured to correspond to the tangential groove of the disk, a second locking groove 714 formed on a second top surface 710, and a second locking hole 716 formed in the second locking groove 714. The second tangential groove 712 secures the second support 700 to the disk.

The center support 800 is interposed between the first support 600 and the second support 700, thereby inhibiting the first support 600 from moving to the second support 700 and inhibiting the second support 700 from moving to the first support 600 in an axial direction YC (e.g. horizontal direction). The center support 800 includes a first slant surface 820 and a second slant surface 830, wherein the first 820 and second 830 slant surfaces help the center support 800 to be inserted along a radial direction ZC, (e.g., vertical direction) between the first support 600 and the second support 700. A center top surface 810 is aligned with the first 614 and second 714 locking grooves such that the center top surface 810 is covered by the upper plate 900.

The upper plate 900 includes a first nut hole 961 and a second nut hole 962, wherein the first nut hole 961 is configured to correspond to the first locking hole 616 and the second nut hole 962 is configured to correspond to the second locking hole 716. The first bolt 951 passes through the first nut hole 961 and is coupled with the first locking hole 616, and the second bolt 952 passes through the second nut hole 962 and is coupled with the second locking hole 716. An axial length of the upper plate 900 in the axial direction YC is the same as the sum of a length of the first locking groove 614, a length of the second locking groove 714, and a length of the center support 800 in the axial direction YC. A tangential width of the upper plate 900 in a tangential direction XC is the same as a width of the center support 800 in the tangential direction XC. Once the first bolt 951 and the second bolt 952 are coupled with the first locking hole 616 and the second locking hole 716, respectively, the first support 600, the second support 700, the center support 800, and the upper plate 900 are secured to each other like blue lines as shown in FIG. 4.

Figure 5:
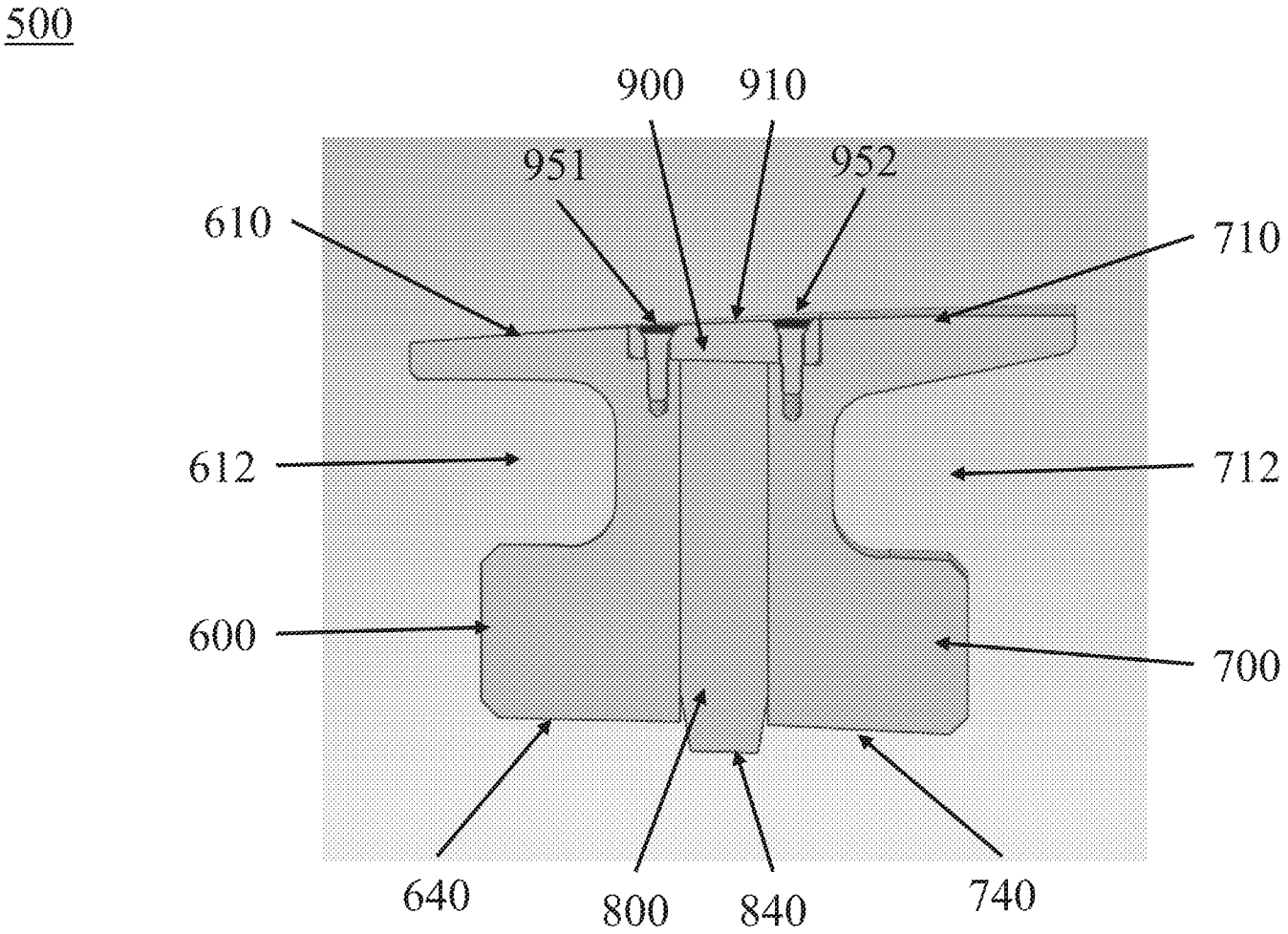
FIG. 5 is a cross-sectional view of a compressor blade locking device according to a second embodiment of the subject invention.

FIG. 5 is a cross-sectional view of a compressor blade locking device according to a second embodiment of the subject invention. Referring to FIG. 5, all components of the compressor blade locking device 500 are secured to each other. The first support 600 is secured to the upper plate 900 through the first bolt 951 and the second support 700 is secured to the upper plate 900 through the second bolt 952. The first top surface 610 of the first support 600 and the second top surface 710 of the second support 700 are aligned with an upper top surface 910 of the upper plate 900, thereby preventing a portion from being protruded from a top surface of the compressor blade locking device 500. By contrast, a center bottom surface 840 of the center support 800 can be protruded beyond a first bottom surface 640 and a second bottom surface 740 such that the center bottom surface 840 is inserted into a groove (not shown) of the disk. In addition, the upper plate 900 can be integral (or monolithic) with the center support 800.

Referring to FIGS. 3-5, the parts of the compressor blade locking device 500 are separately inserted into the disk 170 and then secured to each other, thereby inhibiting the compressor blade locking device 500 from being disengaged from the disk 170. First, the first support 600 and the second support 700 are inserted into the disk 170 such that the first tangential groove 612 and the second tangential groove 712 are secured to the disk 170. Second, the center support 800 is inserted between the first support 600 and the second support 700. Third, the upper support 900 is disposed on the first locking groove 614, the center top surface 810, and the second locking groove 714. Fourth, the first bolt 951 and second bolt 952 pass through the upper plate 900 and are coupled with the first support 600 and the second support 700. As a result, all parts of the compressor blade locking device 500 are secured to each other and the compressor blade locking device 500 is secured to the disk 170.

Figure 6:
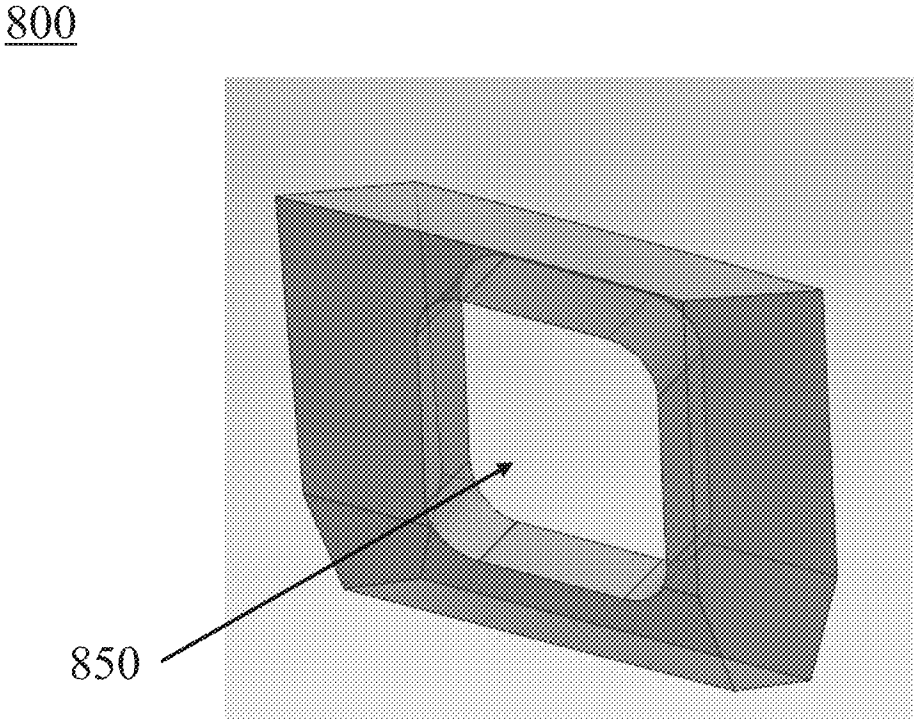
FIG. 6 is a perspective view of a center support according to a third embodiment of the subject invention.

FIG. 6 is a perspective view of a center support according to a third embodiment of the subject invention. The center support 800 can include a hollow 850 in order to decrease a weight of the center support 800, thereby balancing a weight of the compressor blade locking device 500 against a weight of the spacer or a weight of the compressor blade.

Figure 7B:
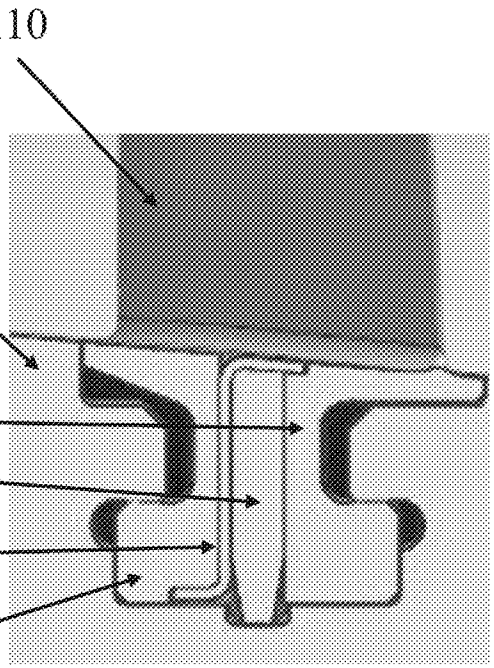
FIGS. 7(*a*) and 7(*b*) are a perspective view and a cross-sectional view of a compressor bladed disk according to a fourth embodiment of the subject invention.
Figure 7A:
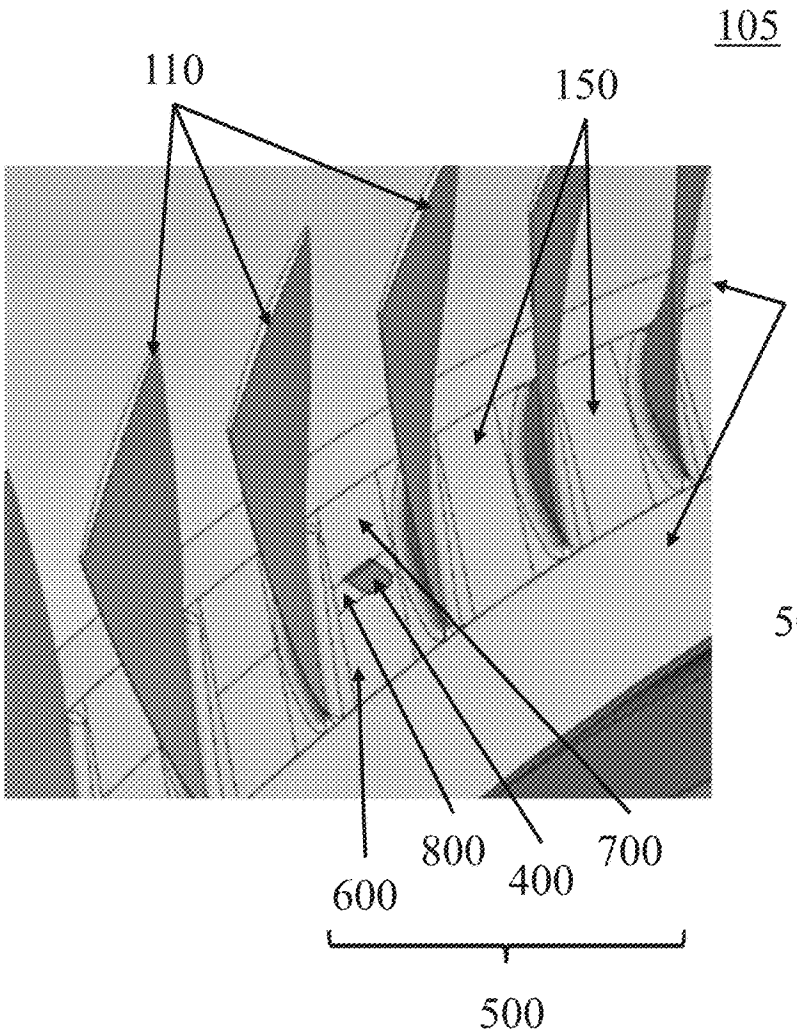

FIGS. 7(*a*) and 7(*b*) are a perspective view and a cross-sectional view of a compressor bladed disk according to a fourth embodiment of the subject invention. The compressor bladed disk 105 includes a disk 170 having a rim shape, a plurality of compressor blades 110 engaged with the disk 170, a plurality of spacers 150 engaged with the disk 170, and a compressor blade locking device 500 engaged with the disk 170. The spacers 150 are placed between the compressor blades 110 and the compressor blade locking device 500 is placed between the compressor blades 110.

The compressor blade locking device 500 includes a first support 600, a second support 700, a center support 800, and a bendable tab 400. Each of the first support 600, the second support 700, the center support 800, and the bendable tab 400 is inserted separately and then coupled with each other through the bendable tab 400 such that the compressor blade locking device 500 is not disengaged from the disk 170.

Figure 8:
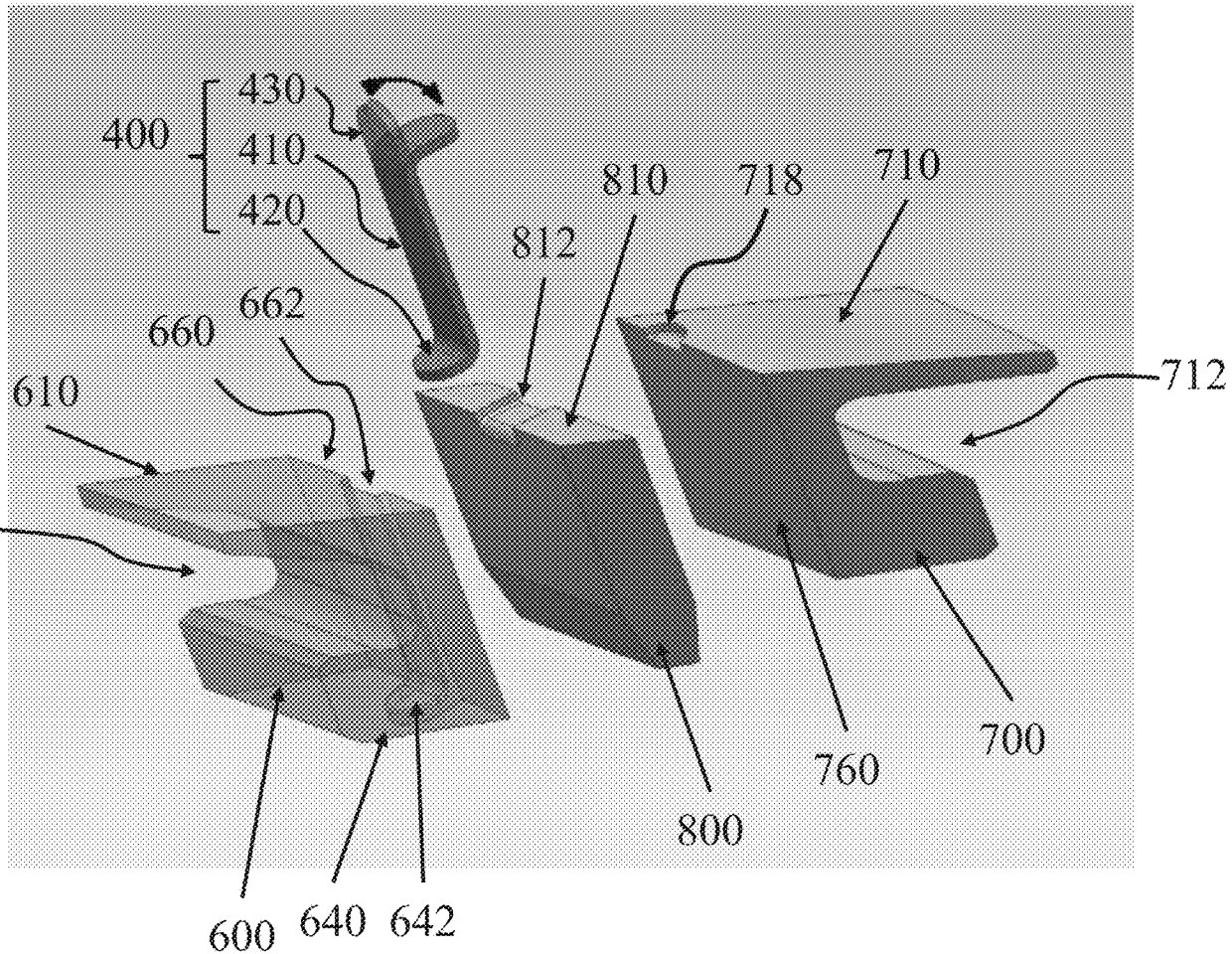
FIG. 8 is an expanded view of a compressor blade locking device according to a fourth embodiment of the subject invention.

FIG. 8 is an expanded view of a compressor blade locking device according to a fourth embodiment of the subject invention. Referring to FIG. 8, it can be seen that in this embodiment, a compressor blade locking device 500 comprises a first support 600, a second support 700, a center support 800, and a bendable tab 400.

The first support 600 includes a first bottom groove 642 on a first bottom surface 640 and a first side groove 662 formed on a first side surface 660. The first side groove 662 extends from the first bottom surface 640 to a first top surface 610 and the first side groove 662 is continuously connected to the first bottom groove 642. In addition, the first support 600 includes a first tangential groove 612 configured to be corresponded and secured to a disk.

The second support 700 includes a second side surface 760 facing the center support 800 and a tab groove 718 formed on a second top surface 710. In addition, the second support 700 includes a second tangential groove 712 configured to be corresponded and secured to the disk.

The center support 800 includes a center top groove 812 formed on a center top surface 810. The center support 800 is interposed between the first side surface 660 of the first support 600 and the second side surface 760 of the second support 700.

The bendable tab 400 includes a tab body 410, a bottom end 420, and a top end 430. The bottom end 420 is bent from the tab body 410 and corresponds to the first bottom groove 642 of the first support 600. The tab body 410 between the bottom end 420 and the top end 430 corresponds to the first side groove 662 of the first support 600. The top end 430 bent from the tab body 410 corresponds to the center top groove 812 of the center support 800 and the tab groove 718 of the second support 700. While the bottom end 420 can be initially bent from the tab body 410, the top end 430 is initially a straight extension from the tab body 410. Once all parts of the compressor blade locking device 500 are inserted into the disk, the top end 430 is bent such that the top end 430 is inserted into the center top groove 812 and the tab groove 718.

Referring to FIGS. 7-8, the parts of the compressor blade locking device 500 are separately inserted into the disk 170 and then secured to each other, thereby inhibiting the compressor blade locking device 500 from being disengaged from the disk 170. First, the first support 600 and the second support 700 are inserted into the disk 170 such that the first tangential groove 612 and the second tangential groove 712 are secured to the disk 170. Second, the bendable tab 400 is inserted into the disk 170 such that the bottom end 420 is inserted into the first bottom groove 642 and the tab body 410 is inserted into the first side groove 662. Third, the center support 800 is inserted between the first support 600 and the second support 700. Fourth, the top end 430 is bent towards the center support 800 and the second support 700 such that the top end 430 is disposed in the center top groove 812 and the tab groove 718. As a result, all parts of the compressor blade locking device 500 are secured to each other and the compressor blade locking device 500 is secured to the disk 170.

Figure 9:
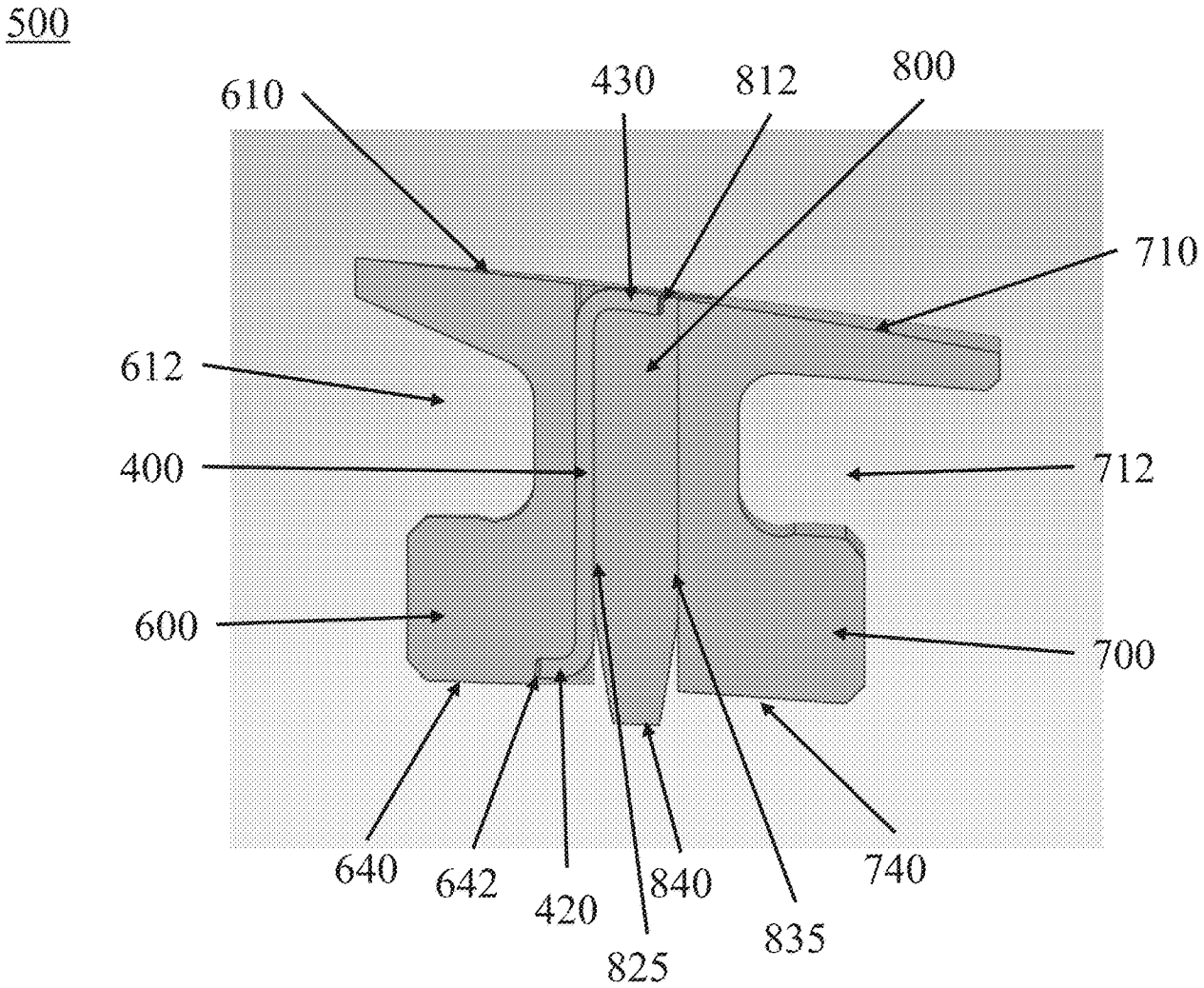
FIG. 9 is a cross-sectional view of a compressor blade locking device according to a fifth embodiment of the subject invention.

FIG. 9 is a cross-sectional view of a compressor blade locking device according to a fifth embodiment of the subject invention. Referring to FIG. 9, the center support 800 includes a first center side surface 825 facing the first support 600 and a second center side surface 835 facing the second support 700. The center top groove 812 of the center support 800 extends from the first center side surface 825 but does not reach to the second center side surface 835. Thus, the top end 430 disposed in the center top groove 812 covers the center support 800 but does not cover the second support 700.

The first support 600 and the second support 700 are coupled with the disk through the first tangential groove 612 and the second tangential groove 712, respectively. The center support 800 is coupled with the first support 600 through the bendable tab 400 including the top end 430 disposed in the center top groove 812 and the bottom end 420 disposed in the first bottom groove 642. Even though the top end 430 is not placed on the second top surface 710, the second support 700 is coupled with other parts of the compressor blade locking device 500 because the center support 800 coupled with the first support 600 inhibits the second support 700 from moving to the first support 600. The center bottom surface 840 is protruded beyond the first bottom surface 640 and the second bottom surface 740, and the top end 430 is aligned with the first top surface 610 and the second top surface 710. As another exemplary embodiment, the center support 800 shown in FIG. 6 can be used to be combined with the bendable tab 400.

The subject invention includes, but is not limited to, the following exemplified embodiments.

Embodiment 1

A compressor blade locking device, comprising:
- a first support including a first locking groove;
- a second support including a second locking groove;
- an upper plate disposed in the first locking groove and the second locking groove; and
- first and second bolts passing through the upper plate and coupled with the first support and the second support, respectively.

Embodiment 2

The compressor blade locking device according to embodiment 1, further comprising a center support interposed between the first support and the second support.

Embodiment 3

The compressor blade locking device according to embodiments 1 or 2, wherein the first support includes a first locking hole formed in the first locking groove, the second support includes a second locking hole formed in the second locking groove, and the first and second bolts are coupled with the first and second locking holes, respectively.

Embodiment 4

The compressor blade locking device according to any of embodiments 1-3, wherein a first top surface of the first support and a second top surface of the second support are aligned with an upper top surface of the upper plate.

Embodiment 5

A compressor blade locking device, comprising:
- a first support including a first top surface;
- a second support including a second top surface;
- a center support interposed between the first support and the second support;
- an upper plate disposed on the first top surface, the second top surface, and a center top surface of the center support;
- a first bolt passing through the upper plate and coupled with the first support; and
- a second bolt passing through the upper plate and coupled with the second support.

Embodiment 6

The compressor blade locking device according to embodiment 5, wherein the first support includes a first locking groove on the first top surface, the second support includes a second locking groove on the second top surface, and the upper plate is inserted into the first and second locking grooves.

Embodiment 7

The compressor blade locking device according to embodiment 6, wherein the first support includes a first locking hole formed in the first locking groove such that the first bolt is coupled with the first locking hole, and the second support includes a second locking hole formed in the second locking groove such that the second bolt is coupled with the second locking hole.

Embodiment 8

The compressor blade locking device according to any of embodiments 5-7, wherein the upper plate is monolithically formed with the center support.

Embodiment 9

The compressor blade locking device according to any of embodiments 5-8, wherein the center support includes a first slant surface facing the first support and a second slant surface facing the second support.

Embodiment 10

The compressor blade locking device according to any of embodiments 5-9, wherein a bottom surface of the center support is protruded beyond a bottom surface of the first support and a bottom surface of the second support.

Embodiment 11

The compressor blade locking device according to any of embodiments 5-10, wherein the center support includes a hollow passing through the center support.

Embodiment 12

The compressor blade locking device according to any of embodiments 5-11, wherein the first top surface and the second top surface are aligned with an upper top surface of the upper plate.

Embodiment 13

The compressor blade locking device according to any of embodiments 5-12, wherein the first support includes a first tangential groove configured to be coupled with a disk and the second support includes a second tangential groove configured to be coupled with the disk.

Embodiment 14

A compressor blade locking device, comprising:
a first support including a first bottom groove;
a second support facing the first support;
a center support interposed between the first support and the second support; and
a bendable tab interposed between the first support and the center support,
wherein the bendable tab comprises:
a bottom end disposed in the first bottom groove;
a tab body interposed between the first support and the center support; and
a top end disposed on a center top surface of the center support.

Embodiment 15

The compressor blade locking device according to embodiment 14, wherein the center support includes a center top groove on the center top surface and the top end of the bendable tab is disposed in the center top groove.

Embodiment 16

The compressor blade locking device according to any of embodiments 14 and 15, wherein the second support includes a tab groove on a second top surface of the second support and the top end of the bendable tab is disposed in the tab groove.

Embodiment 17

The compressor blade locking device according to any of embodiments 14-16, wherein the first support includes a first side groove on a first side surface facing the center support and the tab body of the bendable tab is disposed in the first side groove.

Embodiment 18

The compressor blade locking device according to any of embodiments 14-17, wherein the center support includes a hollow passing through the center support.

Embodiment 19

The compressor blade locking device according to any of embodiments 16-18, wherein a first top surface of the first support and the second top surface of the second support are aligned with a surface of the top end of the bendable tab.

Embodiment 20

The compressor blade locking device according to any of embodiments 14-19, wherein the first support includes a first tangential groove configured to be coupled with a disk and the second support includes a second tangential groove configured to be coupled with the disk.

Embodiment 21

A compressor bladed disk, comprising:
a disk including a tangential groove;
a plurality of compressor blades engaged in the tangential groove of the disk; and
a first locking device engaged in the tangential groove of the disk,
wherein the first locking device comprises:
a first support including a first locking groove and a first tangential groove corresponding to the tangential groove of the disk;
a second support including a second locking groove and a second tangential groove corresponding to the tangential groove of the disk;
a center support interposed between the first support and the second support; and
an upper plate disposed in the first and second locking grooves and coupled with the first and second supports.

Embodiment 22

The compressor bladed disk according to embodiment 21, further comprising a spacer engaged in the tangential groove of the disk, wherein the spacer is placed between the plurality of compressor blades.

Embodiment 23

The compressor bladed disk according to any of embodiments 21 and 22, further comprising a plurality of bolts passing through the upper plate, wherein the plurality of bolts are coupled with the first and second supports.

Embodiment 24

The compressor bladed disk according to any of embodiments 21-23, further comprising a second locking device engaged in the tangential groove of the disk.

Embodiment 25

The compressor bladed disk according to embodiment 24, wherein the second locking device is placed in the tangential groove such that the first and second locking devices are point symmetric with respect to an axis of the disk.

Embodiment 26

A compressor bladed disk, comprising:

a disk including a tangential groove;

a plurality of compressor blades engaged in the tangential groove of the disk; and a first locking device engaged in the tangential groove of the disk, wherein the first locking device comprises:

a first support including a first bottom groove and a first tangential groove corresponding to the tangential groove of the disk;

a second support including a second tangential groove corresponding to the tangential groove of the disk;

a center support interposed between the first support and the second support; and a bendable tab interposed between the first support and the center support, wherein a bottom end of the bendable tab is disposed in the first bottom groove of the first support.

Embodiment 27

The compressor bladed disk according to embodiment 26, further comprising a spacer engaged in the tangential groove of the disk, wherein the spacer is placed between the plurality of compressor blades.

Embodiment 28

The compressor bladed disk according to any of embodiments 26 and 27, wherein the bendable tab includes a top end disposed on a center top surface of the center support.

Embodiment 29

The compressor bladed disk according to embodiment 28, wherein the top end of the bendable tab is disposed on a second top surface of the second support.

Embodiment 30

The compressor bladed disk according to embodiment 29, wherein the second support includes a tab groove on the second top surface of the second support and the top end of the bendable tab is disposed in the tab groove of the second support.

Embodiment 31

The compressor bladed disk according to any of embodiments 28-30, wherein the center support includes a center top groove on the center top surface and the top end of the bendable tab is disposed in the center top groove.

Embodiment 32

The compressor bladed disk according to any of embodiments 26-31, wherein the first support includes a first side groove on a first side surface facing the center support and the bendable tab is disposed in the first side groove.

Embodiment 33

The compressor bladed disk according to any of embodiments 26-u her comprising a second locking device engaged in the tangential groove of the disk.

Embodiment 34

The compressor bladed disk according to embodiment 33, wherein the second locking device is placed in the tangential groove such that the first and second locking devices are point symmetric with respect to an axis of the disk.

It should be understood that the examples and embodiments described herein are for illustrative purposes only and that various modifications or changes in light thereof will be suggested to persons skilled in the art and are to be included within the spirit and purview of this application. Thus, the invention is not intended to limit the examples described herein, but is to be accorded the widest scope consistent with the principles and novel features disclosed herein.

What is claimed is:

1. A compressor blade locking device, comprising:

a first support including a first locking groove having a first planar surface extending in a tangential direction and facing in a radial direction;

a second support including a second locking groove having a second planar surface extending in the tangential direction and facing in the radial direction;

an upper plate disposed in the first locking groove and the second locking groove; and first and second bolts passing through the upper plate and coupled with the first support and the second support, respectively.

2. The compressor blade locking device according to claim 1, further comprising a center support interposed between the first support and the second support.

3. The compressor blade locking device according to claim 2, wherein the first support includes a first locking hole formed in the first locking groove, the second support includes a second locking hole formed in the second locking groove, and the first and second bolts are coupled with the first and second locking holes, respectively.

4. The compressor blade locking device according to claim 3, wherein a first top surface of the first support and a second top surface of the second support are aligned with an upper top surface of the upper plate.

5. A compressor blade locking device, comprising:

a first support including a first top surface;

a second support including a second top surface;

a center support interposed between the first support and the second support;

an upper plate including a bottom surface that is disposed on a center top surface of the center support and sides surfaces that are disposed between the first top surface and the second top surface;

a first bolt passing through the upper plate and coupled with the first support; and a second bolt passing through the upper plate and coupled with the second support.

6. The compressor blade locking device according to claim 5, wherein the first support includes a first locking groove, the second support includes a second locking groove, and the upper plate is inserted into the first and second locking grooves.

7. The compressor blade locking device according to claim 6, wherein the first support includes a first locking hole formed in the first locking groove such that the first bolt is coupled with the first locking hole, and the second support includes a second locking hole formed in the second locking groove such that the second bolt is coupled with the second locking hole.

8. The compressor blade locking device according to claim 7, wherein the upper plate is monolithically formed with the center support.

9. The compressor blade locking device according to claim 7, wherein the center support includes a first slant surface facing the first support and a second slant surface facing the second support.

10. The compressor blade locking device according to claim 7, wherein a bottom surface of the center support is protruded beyond a bottom surface of the first support and a bottom surface of the second support.

11. The compressor blade locking device according to claim 7, wherein the center support includes a hollow passing through the center support.

12. The compressor blade locking device according to claim 7, wherein the first top surface and the second top surface are aligned with an upper top surface of the upper plate.

13. The compressor blade locking device according to claim 8, wherein the first support includes a first tangential groove configured to be coupled with a disk and the second support includes a second tangential groove configured to be coupled with the disk.

14. A compressor blade locking device, comprising:

a first support including a first bottom groove;

a second support facing the first support;

a center support interposed between the first support and the second support; and a bendable tab interposed between the first support and the center support, wherein the bendable tab comprises:

a bottom end disposed in the first bottom groove;

a tab body interposed between the first support and the center support; and a top end disposed on a center top surface of the center support.

15. The compressor blade locking device according to claim 14, wherein the center support includes a center top groove on the center top surface and the top end of the bendable tab is disposed in the center top groove.

16. The compressor blade locking device according to claim 15, wherein the second support includes a tab groove on a second top surface of the second support and the top end of the bendable tab is disposed in the tab groove.

17. The compressor blade locking device according to claim 16, wherein the first support includes a first side groove on a first side surface facing the center support and the tab body of the bendable tab is disposed in the first side groove.

18. The compressor blade locking device according to claim 14, wherein the center support includes a hollow passing through the center support.

19. The compressor blade locking device according to claim 14, wherein a first top surface of the first support and a second top surface of the second support are aligned with a surface of the top end of the bendable tab.

20. The compressor blade locking device according to claim 14, wherein the first support includes a first tangential groove configured to be coupled with a disk and the second support includes a second tangential groove configured to be coupled with the disk.

* * * * *